United States Patent [19]

Olsen et al.

[11] Patent Number: 4,772,354

[45] Date of Patent: Sep. 20, 1988

[54] HEATED SOLVENT APPLICATING GRAVURE ROLL

[75] Inventors: Robert F. Olsen, Lakeland, Fla.; Russell W. Heckman, Perrysburg, Ohio

[73] Assignee: Owens-Illinois Glass Container Inc., Toledo, Ohio

[21] Appl. No.: 28,165

[22] Filed: Mar. 19, 1987

[51] Int. Cl.[4] ..... B05C 11/00; B05C 1/00

[52] U.S. Cl. ..... 156/578; 118/202; 118/212; 118/231; 118/259; 118/667; 156/499

[58] Field of Search ..... 156/578, 499; 118/211-213, 667, 202, 231, 259; 34/109, 132, 134; 29/110

[56] References Cited

U.S. PATENT DOCUMENTS 3,648,651 3/1972 Hinchcliffe et al. ..... 118/212 X 3,750,746 8/1973 Norman ..... 156/578 X 4,549,923 10/1985 Tachibana et al. ..... 156/578 X 4,574,020 3/1986 Fosnaught ..... 156/80

*Primary Examiner*—Michael Ball

*Assistant Examiner*—Jeff H. Aftergut

[57] ABSTRACT

A solvent applicating roll, mounted for rotation about its vertical axis for transferring a solvent from etched or gravure areas on the roll surface to plastic labels that are moved into rolling contact with the roll, has its temperature controlled. The roll is formed as a hollow cylinder with heated air fed to the interior thereof to heat the roll to keep the solvent at a working temperature and prevent evaporative cooling of the roll due to solvent evaporating from the surface during operation. The heated air is passed through a distributor that assures the heated air will effectively transfer its heat to the metal roll.

8 Claims, 3 Drawing Sheets

FIG. 4
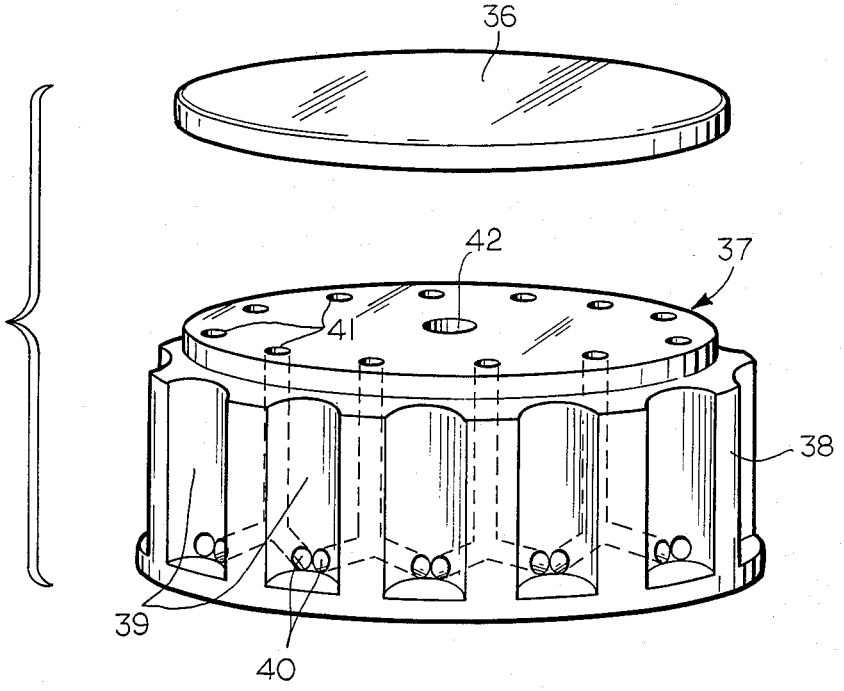
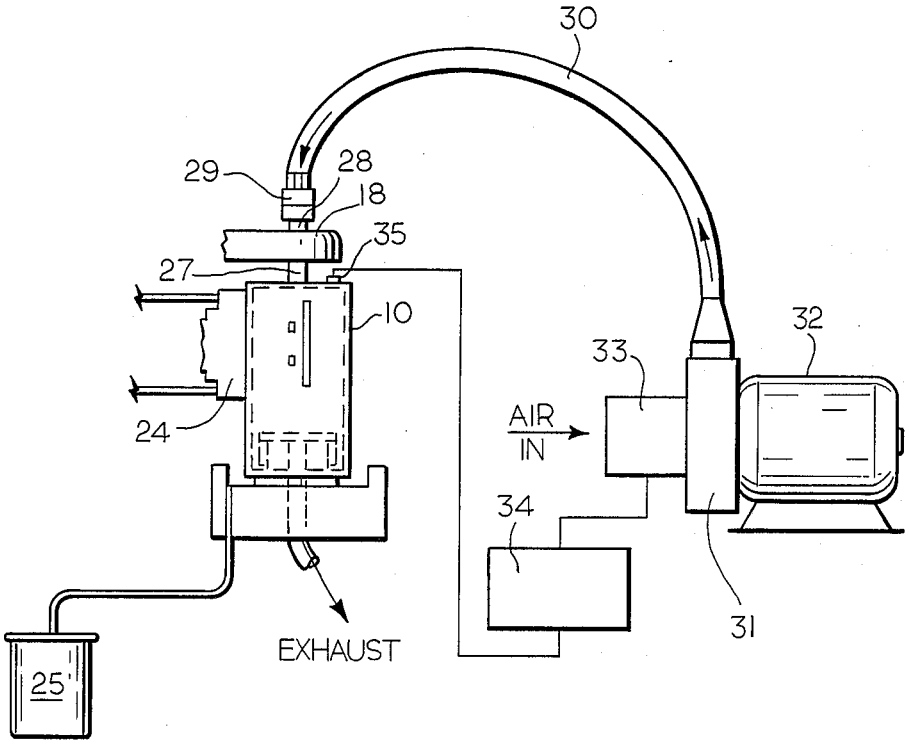
FIG. 5

HEATED SOLVENT APPLICATING GRAVURE ROLL

Field of the Invention

This invention is concerned with heating the gravure roll that is used to apply a solvent to a finite area of the surface of a plastic label that is tacked to a generally cylindrical container and wrapped around the container and adhered to itself. The plastic label is formed of a heat shrinkable material such as a film-foam coextruded plastic with the solvent, in a sense, dissolving a portion of the plastic. The solvent is one which readily evaporates at room temperature resulting in chilling the surface of the gravure roll. Heating the gravure roll to keep its surface temperature above the dew point is a concern of the invention.

BACKGROUND OF THE INVENTION

The application of plastic shrink labels to containers is old in the art and, as set forth in U.S. Pat. No. 3,802,942, label material is cut in strips of predetermined length, wrapped around a mandrel and heat sealed to itself in an overlap seam. The resulting sleeve is telescoped over the container and then passed through a heated tunnel and the sleeve shrinks into conformity with the underlying container. These sleeves were usually positioned on the container such that the sleeve would shrink under the bearing surface, around the heel of the container and extend upward to adjacent the shoulder.

More recently, in U.S. Pat. No. 4,574,020, a process in which the container serves as the mandrel for the label and the wraparound of the label about the container by moving the leading edge of the label into contact with the container sidewall and tacking the label to the container, then rolling the container along the label until the trailing edge of the label overlaps the leading edge and is adhered thereto is disclosed. In this disclosed process the leading edge of the label is tacked to the container by applying a solvent to the label to form a solution with the plastic. This label is also contacted at its trailing edge by a solvent so the solution will form an adhesive for forming a completely formed and sealed sleeve of the label material. The sealed seam must withstand the forces generated when the container and label are passed through a heat shrink tunnel.

In the process set forth in the above-mentioned U.S. Pat. No. 4,574,020, the adhesive that is used is formed by dissolving a small finite area of the plastic label by applying a solvent thereto. The solvent, such as methyl methacrylate, is volatile and readily evaporates at room temperature. The solvent is applied to the label areas by contact with a gravure roll that carries the solvent applicating pattern in its surface. The solvent is applied to the gravure roll surface by contact with a fountain containing the solvent being held against the rotating surface of the gravure roll. Sufficient solvent is captured in the gravure pattern so that it will transfer by contact with the plastic label to cause it to form a solution and this solution acts as the adhesive for tacking the label to the container and forming a full height, overlapping seal that will withstand the tension produced by passing the label carrying container through a heat tunnel to cause the label to shrink, primarily circumferentially about the container.

The solvent is applied from a fountain and the excess solvent is doctored from the surface of the roll, but a thin film of the solvent will generally be left on the roll surface and this thin film will evaporate and cause the roll surface to become chilled. When the temperature of the roll surface drops below the dew point of the ambient air, there will be condensation of moisture on the roll surface. This water condensation will disturb the solvent transfer characteristics of the gravure roll and result in the label seal not being satisfactorily completed.

SUMMARY OF THE INVENTION

It is an object of this invention to maintain the surface temperature of a solvent applicating gravure roll at a temperature above the dew point to avoid condensation of water vapor on the exterior surface thereof.

Other objects will be apparent from the following description taken in conjunction with the annexed sheets of drawings.

BRIEF DESCRIPTION OF THE DRAWINGS

FIG. 4 is a perspective view, on a reduced scale, of the fluid distributor of FIG. 2; and FIG. 5 is a schematic elevational view of the gravure roll heating and temperature control system of the invention.

DETAILED DESCRIPTION OF THE INVENTION

The present invention, as shown in the annexed sheets of drawings, is concerned with the function of a gravure roll for applying a solvent to selected areas of a plastic label for adhering the label to a container. As mentioned in the Background of the Invention, such a system is discussed in U.S. Pat. No. 4,574,020, issued Mar. 4, 1986, where the solvent that is used, because of its volatility, is refrigerated, before being supplied to the fountain for the gravure roll, in an effort to conserve the solvent and control the amount transferred.

Figure 1:
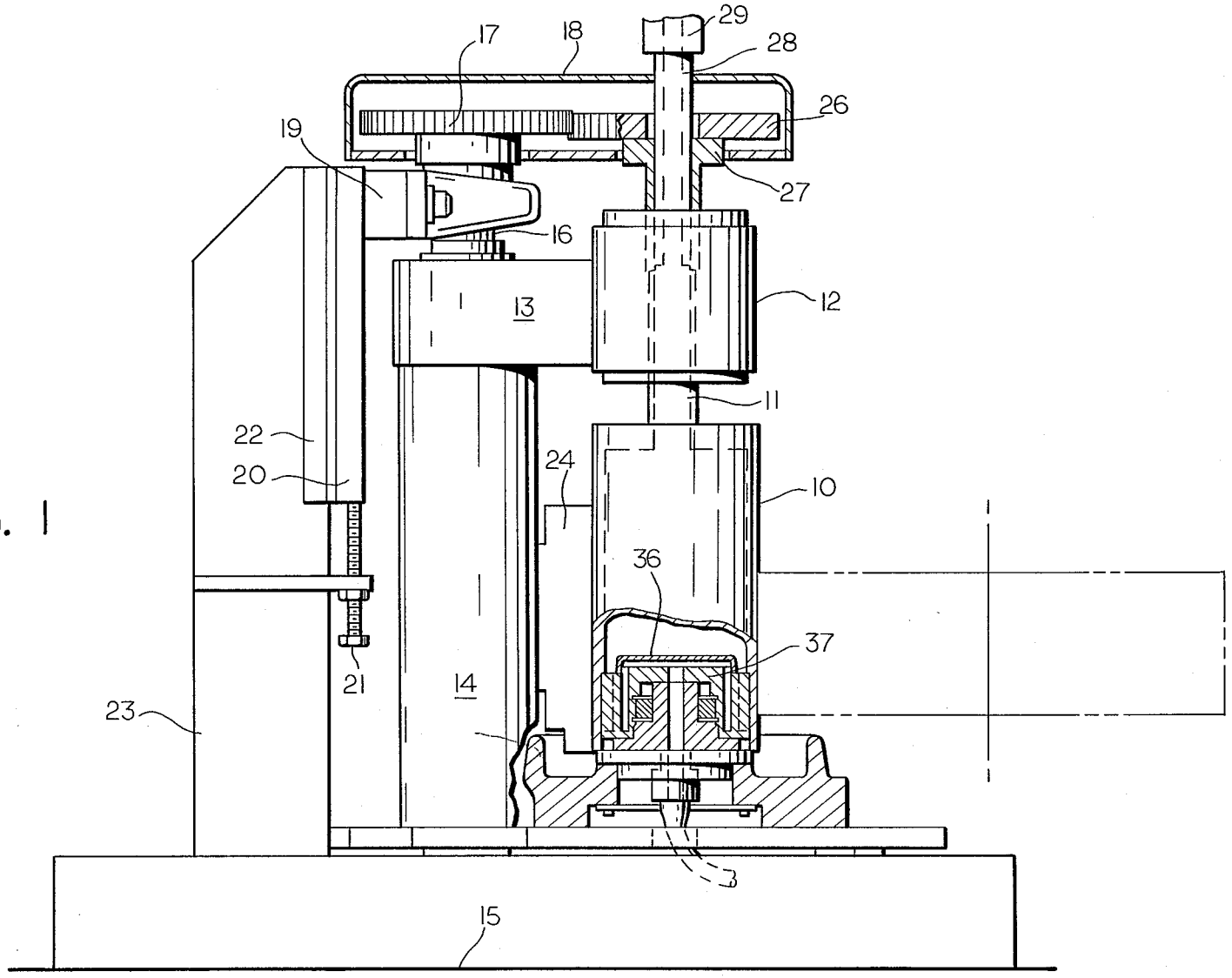
FIG. 1 is a side elevational view, with parts broken away, of the solvent applying gravure roll of the invention and its mounting.
Figure 2:
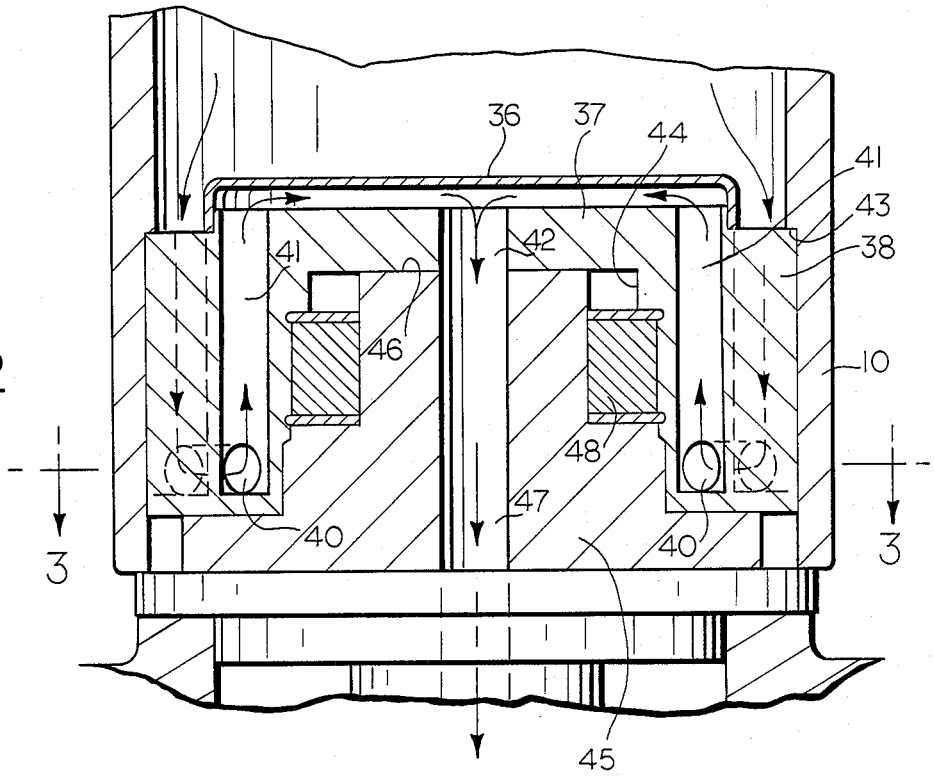
FIG. 2 is a vertical, cross-sectional view on an enlarged scale of the lower end of the gravure roll of FIG. 1.
Figure 3:
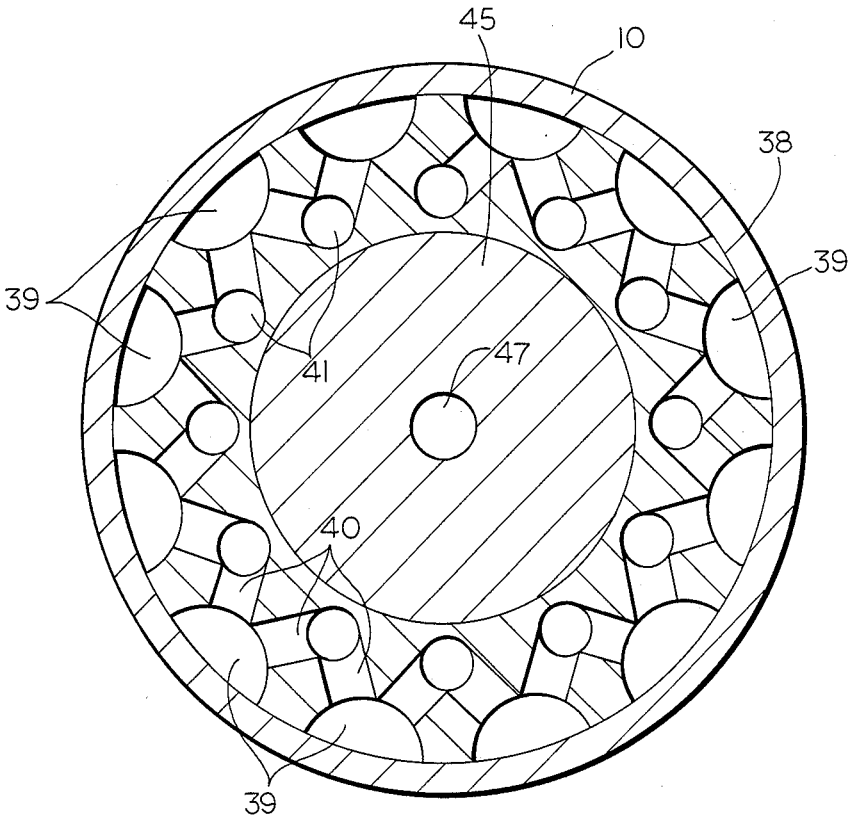
FIG. 3 is a cross-sectional view taken at line 3—3 of FIG. 2.

With this in view, the present invention will be described in detail. With reference to FIG. 1 of the drawings, there is shown a right cylindrical gravure roll 10 mounted to the lower end of a vertical shaft 11. The shaft 11 is supported from above by a bearing housing 12 which is fixed to an arm 13 mounted on the upper end of a stationary post 14. The lower end of the post 14 is fixed to a stationary support base 15. Extending upward out of the post 14 is a drive shaft-16 which has a spur gear 17 at its upper end. The shaft 16 and the spur gear 17 are supported by a bearing housing 18 fixed to a mounting block 19 which in turn is carried by the upper end of a vertical slide 20. The slide 20 is vertically adjustable by a threaded bolt 21 in engagement with its lower end. The bolt 21 and a slideway 22 are fixed to vertical support 23 which is also mounted to the base 15.

A solvent applicating fountain 24, as shown in FIGS. 1 and 5, is supported in contact with the surface of the gravure roll. The solvent is supplied to the gravure roll, in the manner taught in U.S. Pat. No. 4,574,020, mentioned above, where it is shown that any excess solvent may be recovered and recirculated to the fountain from a suitable supply schematically illustrated at 25 in FIG. 5.

The spur gear 17 is in mesh with another spur gear 26 which is mounted on the upper end 27 of the drive shaft 11. Extending coaxial with the upper end 27 of the shaft 11 is a supply tube 28. The upper end of the pipe 28 is fixed in the bottom of a rotary coupling 29, as shown in FIG. 5. The upper end of the coupling 29 is connected to a hose 30 which extends to the outlet of an air blower 31. The blower 31 is driven by a motor 32 and draws air in through a heater 33. The heater 33 may typically be a "series 68", Athena Flameless Torch made by the Athena Company of Plymouth Meeting, Pa.

The heater 33 has its temperature controlled by a control box 34 that is connected to a temperature sensing device 35, such as a thermocouple, that is in contact with the gravure roll. Thus it can be seen that heated air will be delivered to the interior of the gravure roll 10 through the hose 30. The controller may be a "Watlow Controller". The heated air that enters from the top of the gravure roll will pass down into the interior of the roll 10 and be deflected toward the inner surface by a cover plate 36 that overlies a distributor 37. The distributor 37 is in the form of a circular disk or bottom closing member 38 shown in perspective in FIG. 4. A plurality of circumferentially spaced-apart, semi-cylindrical passages 39 are formed in the outer surface of said member 38. These passages 39 do not extend through the bottom of the member 38 but communicate, adjacent their lower ends, with a series of horizontal passages 40 which have their inner ends terminating in a series of vertical passages 41. The vertical passages 41 extend upward through the top of the disk or member 38. The cover plate 36 is mounted on the disk 38 but is spaced from the upper surface so as to confine heated air to an area above the passages 41.

A central, exhaust passage 42 is provided and it extends through the full height of the member 38. The member 38 has an overall diameter that is slightly larger than the inner diameter of the main portion of the gravure roll, but the lower end of the gravure roll has an increased inner diameter at 43 within which the member 38 may be seated. The member 38 is formed with an enlarged central bore 44 within which a bearing support shaft 45 extends. The stub shaft 45 has an upper surface 46 which is in close proximity to the under surface of the member 38 and a central bore 47 in alignment with passage 42. The stub shaft 45 carries a bearing 48 which fits within the bore 44 of the member 38. Thus the gravure roll 10 is supported for rotation about its vertical axis by the stub shaft 45.

The heated air that is delivered from the blower 31 to the interior of the gravure roll is forced to engage the interior roll surface by the distributor 37 or member 38 and thus transfer its heat to the roll 10. The air, after contacting the interior of the roll at an area very close to the bottom of the roll, is directed out through the axial exhaust passages.

The surface temperature of the roll, which is made of metal such as aluminum, is sensed and the air is heated and controlled so as to maintain the temperature of the roll surface above the dew point temperature of the atmosphere in the area of the labeling machine. The location of the thermocouple or temperature sensor should be chosen so that its reading may be accurately equated to dew point.

While schematic FIG. 5 shows the temperature sensor in contact with the top of the roll, it is not as accurate as having the sensor in contact with the roll surface in the area where the solvent is being applied to the roll. In the system illustrated in FIG. 1, placing the temperature sensor in contact with the roll surface between 4 and 4.5 inches from the bottom or, preferably 4.25 inches from the bottom was desirable since this was in the solvent applied surface area of the roll.

It has been found that with the Watlow Controller, which is a proportronal on/off type controller, the Athena flameless torch system is timed on and off with the Watlow set at about 75° F. this being above the dew point temperature of ambient conditions in a plant atmosphere.

The tube heater 33 that air flows through will heat the air to a peak of about 800° F. and the controller protects the tube heater from overload and regulates the maximum power to the torch at any given time. It has been found that a flow rate of 5 scfm is preferred and the system is dimensioned to provide this flow rate at a pressure of about 20 psi.

An acceptable range of flow rates for the heated air would be 3–7 scfm, but 5 scfm is the preferred rate.

While the foregoing describes a detailed system for preventing condensation on the surface of a solvent applying gravure roll in a labeling system, it should be apparent that some departure from the details may be made but will still fall within the spirit and scope of the appended claims.

What is claimed:

1. An improved solvent applicating gravure roll for applying solvent to finite areas of a thermoplastic label carried on the peripheral surface of a rotating vacuum drum and the label is transferred to the surface of a generally cylindrical container and wound thereabout to become adhered to itself to form a wraparound label on one container, wherein the gravure roll is supported for rotation about a vertical axis with its periphery contacting a solvent fountain and the label supported on the drum, the improvement in the gravure roll comprising a vertical passage extending downward through an upper spindle supporting the upper end of said roll, said roll being a generally hollow cylinder, a bottom closing member in the bottom of said cylinder, a vertical recess in said bottom closing member, a lower, vertical spindle extending upward into said recess, bearing means between said lower spindle and recess for supporting said cylinder bottom for rotation about its vertical axis, a pipe extending into alignment with said upper spindle, a rotary coupling between said upper spindle and pipe for permitting said upper spindle to rotate relative to said pipe yet maintain communication between the pipe and the interior of said upper spindle, a source of heated air connected to said pipe, flow directing passages formed in said bottom closing member for directing air downward along the inner surface of the lower end of said roll and thence toward the center of said bottom closing member, and an exhaust passage extending through said lower spindle for receiving the heated air from the interior of said roll.

2. The apparatus of claim 1 wherein said heated air supply comprises a flameless torch, connected between a source of air and said pipe and an electrical source control means connected to said torch.

3. The apparatus of claim 2 wherein said control means includes a contact thermocouple in contact with the surface of the roll, switch means connected between said electrical power source and said torch and a controller connected between said switch and said thermocouple for opening and closing said switch when the thermocouple senses temperature above or below a set point temperature.

4. The apparatus of claim 1 further comprising means for heating said air to above 75° F., to maintain the surface temperature of the drum above the dew point temperature of ambient air.

5. The apparatus of claim 1 further including pressure regulating means connected to said supply of heated air for flowing compressed air through the roll at the rate of 3–7 scfm.

6. The apparatus of claim 5 wherein said pressure regulator is set to feed the air at 5 scfm.

7. The apparatus of claim 3 wherein said thermocouple is mounted to contact said drum at between 4 and 4.5 inches from the bottom thereof.

8. The apparatus of claim 7 wherein the contact thermocouple is mounted to contact the drum surface at 4.25 inches from the bottom thereof.

* * * * *